US011801585B2

(12) United States Patent
Yen

(10) Patent No.: US 11,801,585 B2
(45) Date of Patent: Oct. 31, 2023

(54) PLIERS

(71) Applicant: Kauw Yehi Industrial Co., Ltd., New Taipei (TW)

(72) Inventor: Yu-Ting Yen, New Taipei (TW)

(73) Assignee: KAUW YEHI INDUSTRIAL CO., LTD., New Taipei (TW)

( * ) Notice: Subject to any disclaimer, the term of this patent is extended or adjusted under 35 U.S.C. 154(b) by 264 days.

(21) Appl. No.: 17/377,346

(22) Filed: Jul. 15, 2021

(65) Prior Publication Data

US 2023/0015864 A1 Jan. 19, 2023

(51) Int. Cl.
*B25B 7/02* (2006.01)
*B25B 7/06* (2006.01)

(52) U.S. Cl.
CPC . *B25B 7/02* (2013.01); *B25B 7/06* (2013.01)

(58) Field of Classification Search
CPC ..... B25B 7/02; B25B 7/06
USPC ..... 7/125, 131, 132
See application file for complete search history.

(56) References Cited

U.S. PATENT DOCUMENTS 591,720 A * 10/1897 Armstrong ..... B25B 7/02 7/142
1,134,177 A * 4/1915 Bernard ..... B25B 7/02 30/182
1,388,398 A * 8/1921 Adams ..... H02G 1/1214 81/332
1,514,488 A 11/1924 Wernimont
3,831,207 A * 8/1974 Boyajian ..... H02G 1/1214 D8/58
6,473,925 B1 * 11/2002 Konen ..... B25B 7/18 7/107

FOREIGN PATENT DOCUMENTS

CN 208062684 U 11/2018
CN 209665157 U 11/2019

OTHER PUBLICATIONS

Search Report dated Dec. 17, 2021 of the corresponding European patent application No. 21186498.8.

* cited by examiner

*Primary Examiner* — Hadi Shakeri
(74) *Attorney, Agent, or Firm* — Chun-Ming Shih; HDLS IPR SERVICES

(57) ABSTRACT

A pliers includes a first pliers body (10) and a second pliers body (20). The first pliers body includes a first handle (11) and a first clamp (12). A first pliers knife (13) and a first pliers back (14) are disposed on the first clamp (12). The second pliers body (20) includes a second handle (21) and a second clamp (22). A second pliers knife (23) and a second pliers back (24) are disposed on the second clamp (22). The second clamp (22) is pivotally connected with the first clamp (12) to clamp or cut. The first pliers back (14) or the second pliers back (24) is provided with a chipping blade (50) configured in a concave arc shape for chipping.

7 Claims, 7 Drawing Sheets

PLIERS

BACKGROUND

Technical Field

The technical field relates to a hand tool, and particularly relates to a pliers with multifunction.

Description of Related Art

A hand tools is one of the necessary tools for performing telecommunications maintenance or water and electricity configuration. For example, a multifunction pliers is a hand tool used for stripping outer insulation layers of cables or wires to perform operations of cutting, sharpening and clamping etc., to the workpiece.

Moreover, the handles of the multifunctional hand tool of the related art has to be opened to expose the knives on inner sides of two pliers to perform operations of cutting and chipping. However, since multiple kinds of knives are provided on inner sides of the two pliers, the user may likely be injured when performing operations of cutting between the two pliers. Additionally, other portions of the workpiece may be damaged when the cutting is performed on the middle part of the workpiece by using the knives on inner sides of the two pliers.

In view of the above drawbacks, the inventor proposes this disclosure based on his expert knowledge and elaborate researches in order to solve the problems of related art.

SUMMARY OF THE DISCLOSURE

One object of this disclosure is to provide a pliers with multifunction, wherein one of the first pliers back and the second pliers back is provided with a chipping blade configured in a concave arc shape for chipping, so as to enhance the safety of use.

In the embodiment of this disclosure, a pliers includes a first pliers body and a second pliers body. The first pliers body includes a first handle and a first clamp connected to a front end of the first handle. A first pliers knife and a first pliers back are disposed on opposite sides of the first clamp. The second pliers body includes a second handle and a second clamp connected to a front end of the second handle. A second pliers knife and a second pliers back are disposed on opposite sides of the second clamp. The second clamp is pivotally connected with the first clamp to make the first pliers knife be connectable with the second pliers knife correspondingly to clamp or cut. One of the first pliers back and the second pliers back is provided with a chipping blade configured in a concave arc shape for chipping.

In comparison with the related art, the pliers of this disclosure is provided with a chipping blade configured in a concave arc shape for chipping and disposed on one of the first pliers back and the second pliers back. As a result, the chipping may be performed without causing damage to the workpiece. Additionally, when the user performs the chipping, the first clamp and the second clamp are held in a closed status to prevent the user from touching the knives. Moreover, the chipping blade of this disclosure includes an arc-shaped recess and a straight cut, and the blade angles of the arc-shaped recess and the straight cut may be less sharp. Thus, the operation of chipping is realized mainly by the bottom of the arc-shaped recess to avoid injury when the user touches the edge of the chipping blade, so as to enhance the safety of use.

BRIEF DESCRIPTION OF THE DRAWINGS

The features of the disclosure believed to be novel are set forth with particularity in the appended claims. The disclosure itself, however, may be best understood by reference to the following detailed description of the disclosure, which describes a number of exemplary embodiments of the disclosure, taken in conjunction with the accompanying drawings, in which:

DETAILED DESCRIPTION

Figure 1:
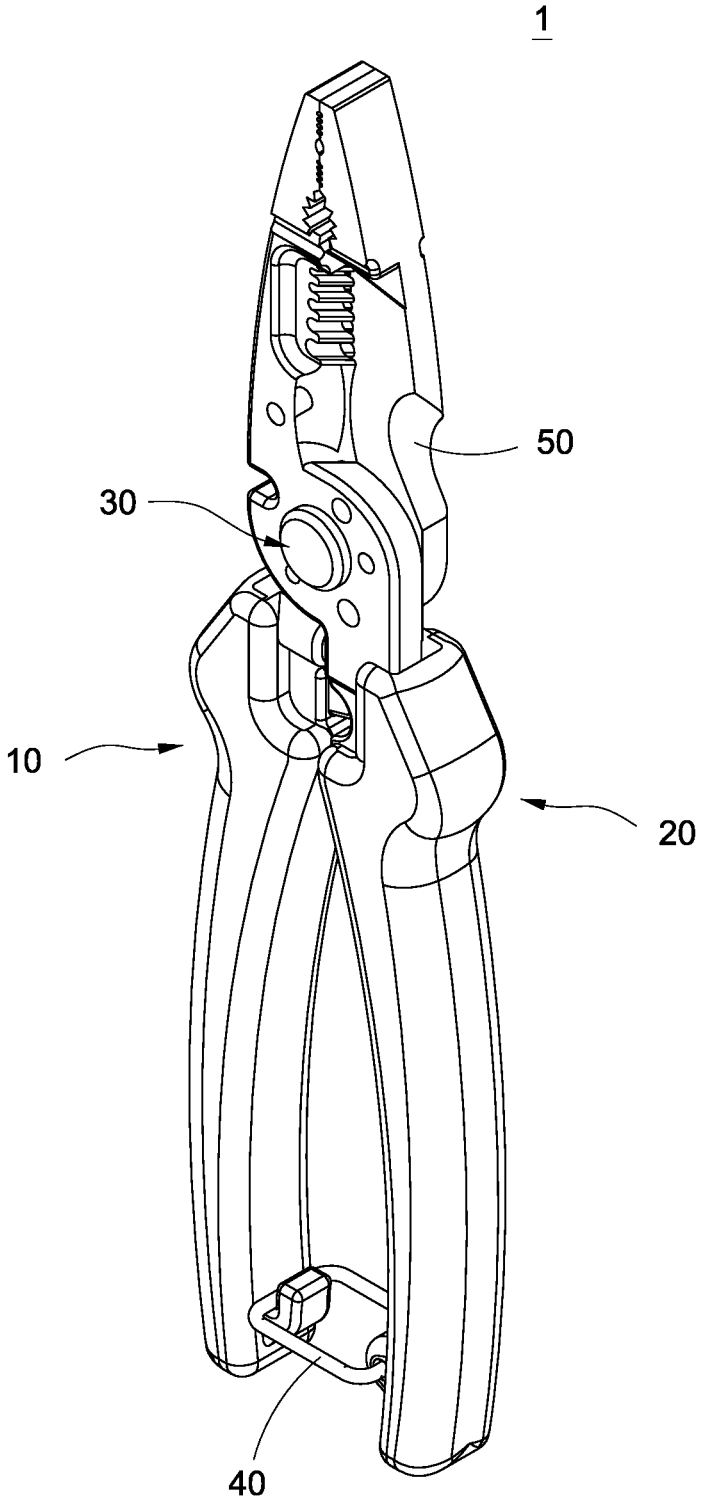
FIG. 1 is a perspective schematic view of the pliers of this disclosure.

The technical contents of this disclosure will become apparent with the detailed description of embodiments accompanied with the illustration of related drawings as follows. It is intended that the embodiments and drawings disclosed herein are to be considered illustrative rather than restrictive.

Please refer to FIG. 1 to FIG. 4, which depict a perspective schematic view and a perspective explosion view of the pliers with multifunction of this disclosure, a front view of the pliers with multifunction of this disclosure when the pliers bodies are opened, and a front view of the pliers with multifunction of this disclosure when the pliers bodies are closed. A pliers 1 (for example, but not limited to, a crimping pliers) with multifunction of this disclosure includes a first pliers body 10 and a second pliers body 20. The first pliers body 10 and the second pliers body 20 are pivotally connected through a pivot assembly 30 to perform operations such as clamping, crimping, cutting, stripping and chipping. In this embodiment, the pliers 1 further includes a buckle 40. The buckle 40 is connected to the bottom of one of the first pliers body 10 and the second pliers body 20. Accordingly, the first pliers body 10 is engaged with the second pliers body 20 through the buckle 40 without being separated.

As shown in the figures, the first pliers body 10 includes a first handle 11 and a first clamp 12 connected to the front end of the first handle 11. A first pliers knife 13 and a first pliers back 14 are disposed on opposite sides of the first clamp 12.

Similarly, the second pliers body 20 includes a second handle 21 and a second clamp 22 connected to the front end of the second handle 21. A second pliers knife 23 and a second pliers back 24 are disposed on opposite sides of the second clamp 22. Additionally, the second clamp 22 is pivotally connected with the first clamp 12 to make the first pliers knife 13 and the second pliers knife 23 be connectable correspondingly to perform operations of clamping or cutting. It should be noted that one of the first pliers back 14 and the second pliers back 24 is provided with a chipping blade 50 configured in a concave arc shape for chipping. In this embodiment, the chipping blade 50 is disposed on the first pliers back 14.

Moreover, the pliers 1 further includes a spring 60. The spring 60 is disposed between the first pliers body 10 and the second pliers body 20 to provide the restoring force therebetween.

Figure 2:
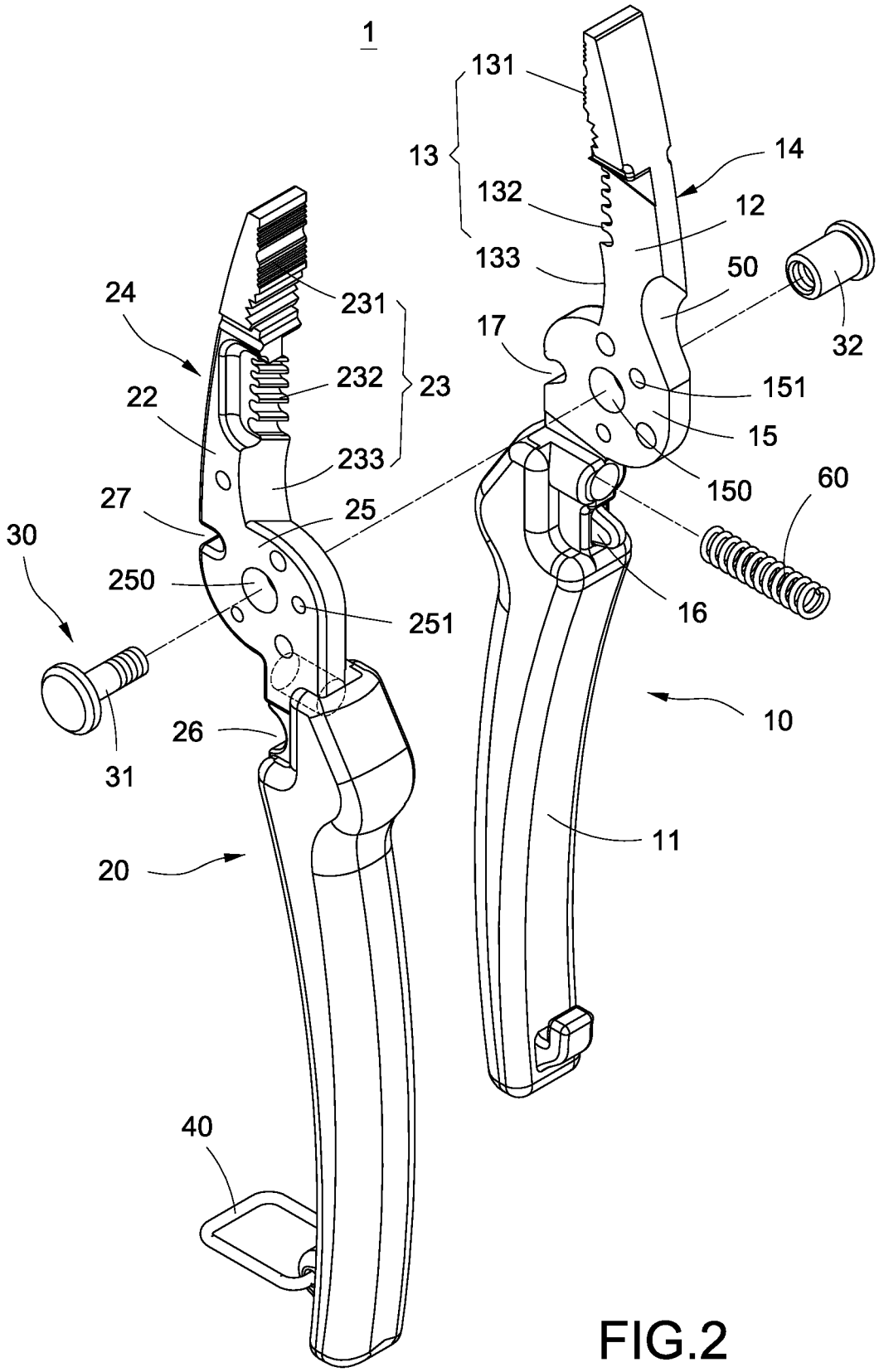
FIG. 2 is a perspective exploded view of the pliers with multifunction of this disclosure.
Figure 3:
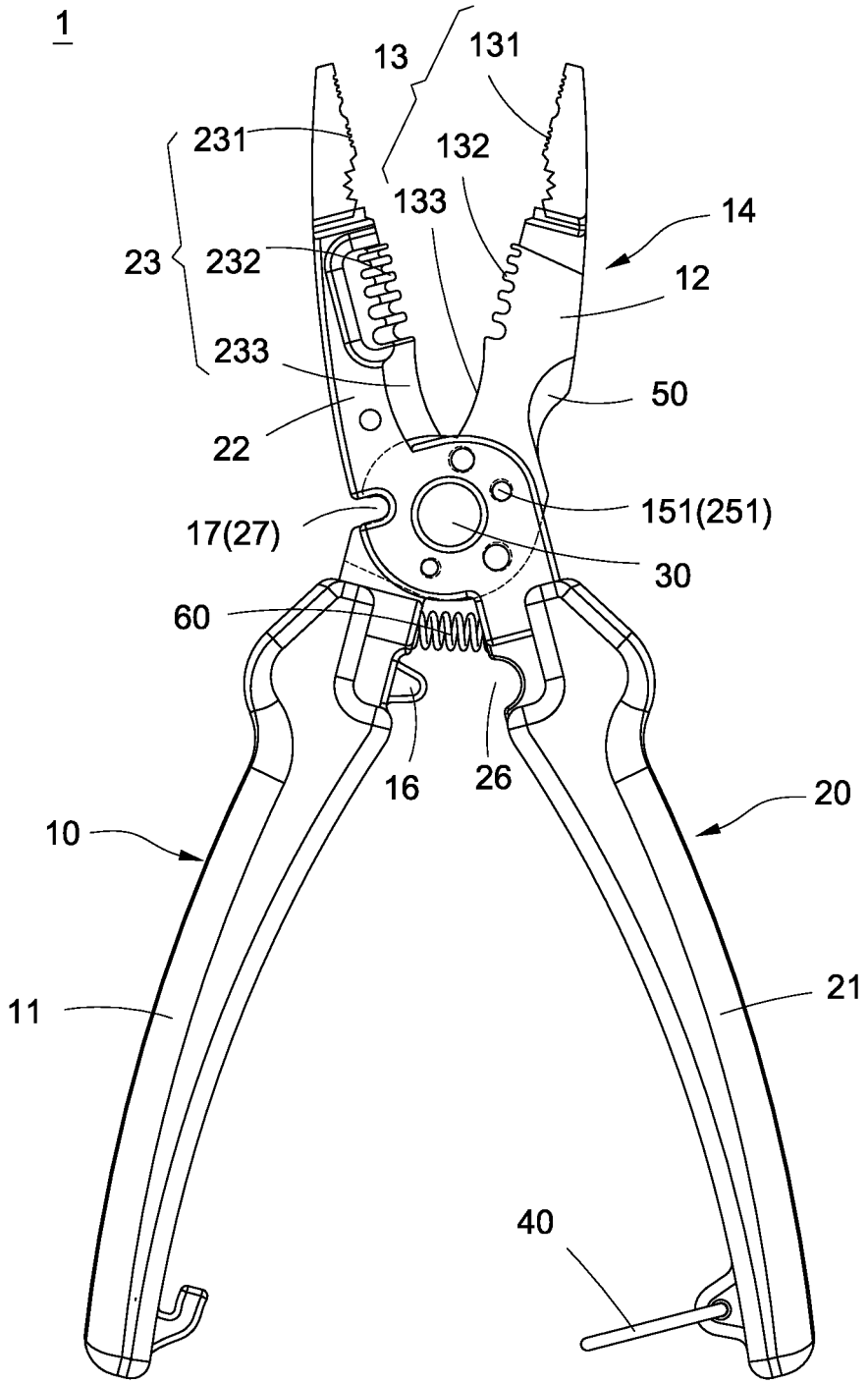
FIG. 3 is a front view of the pliers with multifunction of this disclosure when the pliers bodies are opened.
Figure 4:
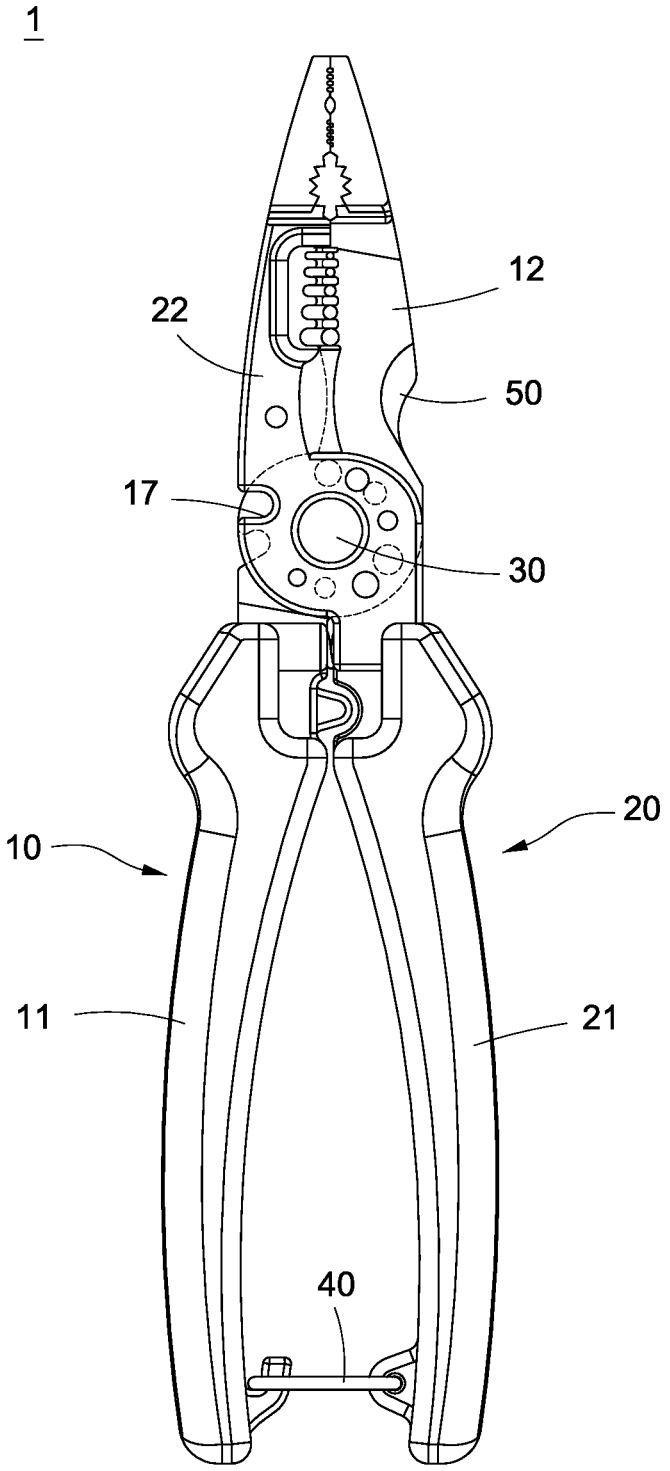
FIG. 4 is a front view of the pliers with multifunction of this disclosure when the pliers bodies are closed.

Please refer to FIG. 2, the pivot assembly 30 includes a bolt 31 and a stud 32. The first pliers body 10 and the second pliers body 20 are pivotally combined with each other through the bolt 31 and the stud 32.

Specifically, the first pliers body 10 includes a first transition section 15 located between the first handle 11 and the first clamp 12, and the first transition section 15 includes a first perforation 150. Additionally, the second pliers body 20 includes a second transition section 25 located between the second handle 21 and the second clamp 22. The second transition section 25 includes a second perforation 250 disposed corresponding to the first perforation 150. The bolt 31 and the stud 32 of the pivot assembly 30 are inserted in the first perforation 150 and the second perforation 250. As a result, the first pliers body 10 and the second pliers body 20 are pivotally connected, and the pliers 1 may be used to perform multiple operations to a workpiece.

In more detail, the first transition section 15 is provided with a plurality of first cutting holes 151 around the first perforation 150. Additionally, the second transition section 25 is provided with a plurality of second cutting holes 251 around the second perforation 250. The first cutting holes 151 and the second cutting holes 251 are arranged correspondingly and are connectable to perform cutting to the workpiece.

Furthermore, the first clamp 12 includes a first bending protrusion 16 located adjacent to a lower side of the first transition section 15 and a first U-shaped notch 17 located adjacent to an upper side of the first transition section 15. Furthermore, the second clamp 22 includes a second bending notch 26 located adjacent to a lower side of the second transition section 25 and a second U-shaped notch 27 located adjacent to an upper side of the second transition section 25. The first bending protrusion 16 and the second bending notch 26 are arranged correspondingly and are connectable to perform bending to the workpiece. The first U-shaped notch 17 and the second U-shaped notch 27 are arranged correspondingly and are connectable to perform cutting to the workpiece with high hardness.

In one embodiment of this disclosure, the first pliers knife 13 includes a first clamping section 131, a first stripping section 132 and a first cutting section 133. Moreover, the second pliers knife 23 includes a second clamping section 231, a second stripping section 232 and a second cutting section 233. The first clamping section 131 and the second clamping section 231 are arranged correspondingly and are connectable to perform clamping to the workpiece. The first stripping section 132 and the second stripping section 232 are arranged correspondingly and are connectable to perform stripping to the workpiece. The first cutting section 133 and the second cutting section 233 are arranged correspondingly and are connectable to perform cutting to the workpiece.

Figure 5:
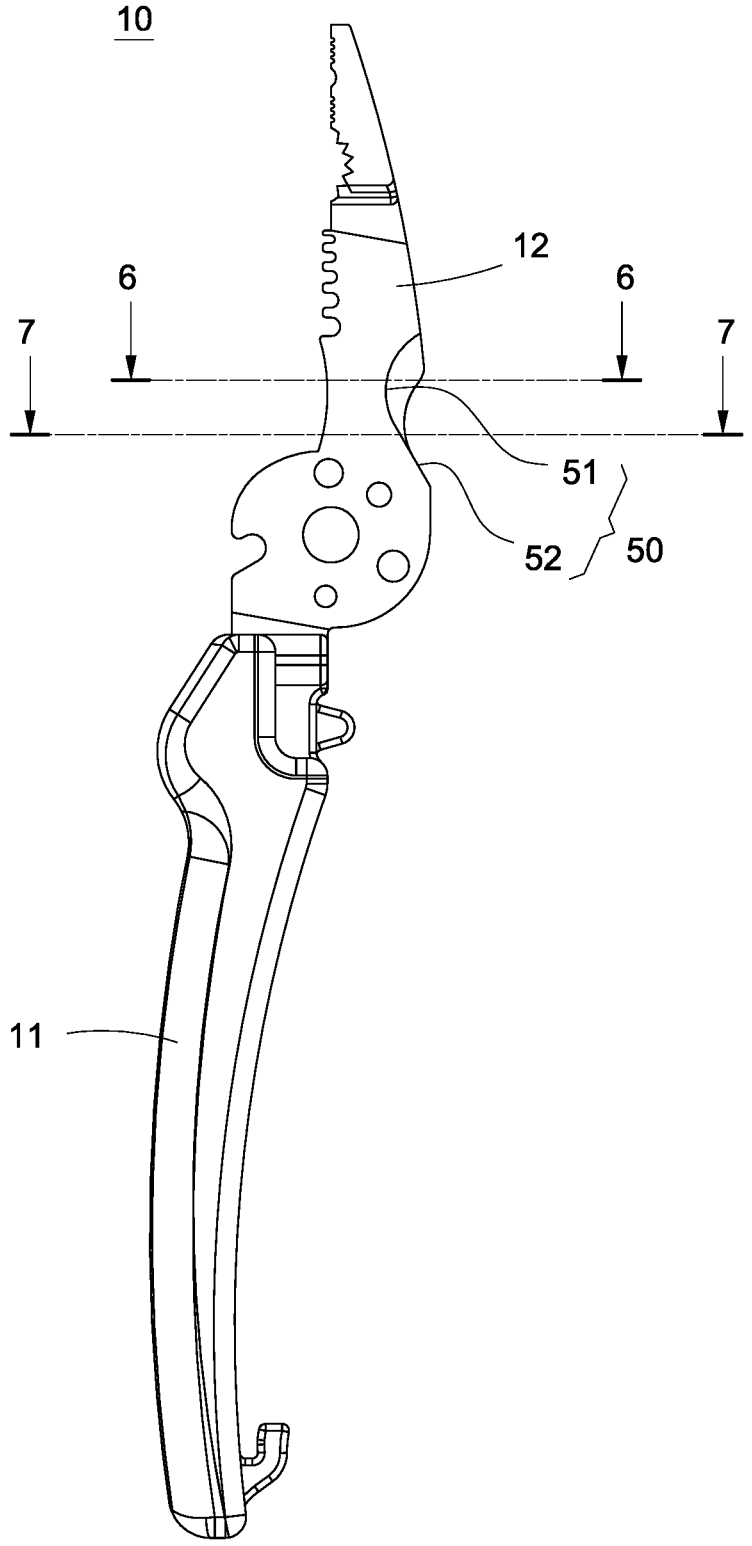
FIG. 5 is a front view of the first pliers body of the pliers with multifunction of this disclosure.
Figure 6:
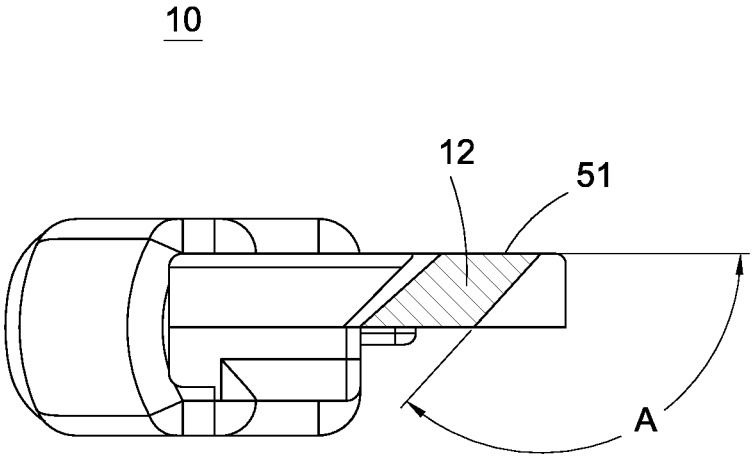
FIG. 6 is a cross sectional view along the line 6-6 of the FIG. 5.
Figure 7:
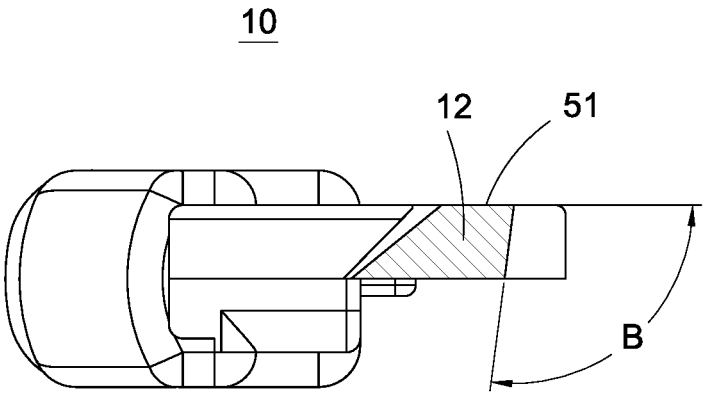
FIG. 7 is a cross sectional view along the line 7-7 of the FIG. 5.

Please further refer to FIG. 5 to FIG. 7, which depict a front view of the first pliers body of the pliers with multifunction of this disclosure and two cross sectional views of the planer blade of the first pliers body of the pliers with multifunction of this disclosure. As shown in FIG. 5, the chipping blade 50 includes an arc-shaped recess 51 and a straight cut 52 extended from the arc-shaped recess 51. Additionally, two cross sectional views are relative to the positions of the arc-shaped recess 51 and the straight cut 52 respectively.

As shown in FIG. 6, the arc-shaped recess 51 includes a blade angle A varied on different locations, and the range of the blade angle A is equal to or greater than 120 degrees and equal to or less than 135 degrees, and the deviation range is plus/minus 5 degrees. For example, taking the bottom of the arc-shaped recess 51 as an example, the sharpest point of the blade angle A is approximately 130 degrees. Thus, the blade angle A of the arc-shaped recess 51 is less sharp, so as to provide a safety use. Furthermore, as shown in FIG. 7, the straight cut 52 includes a cut angle B, and the range of the cut angle B is equal to or greater than 85 degrees and equal to or less than 95 degrees, and the deviation range is plus/minus 5 degrees.

It should be noted that since the range of the blade angle A of the arc-shaped recess 51 is disposed between 120 degrees and 135 degrees, and the blade angle B of the straight cut 52 is disposed between 85 degrees and 95 degrees. Thus, the operation of chipping is realized mainly at the bottom of the arc-shaped recess 51 to avoid injury when the user touches the edge of the chipping blade 50.

Figure 8:
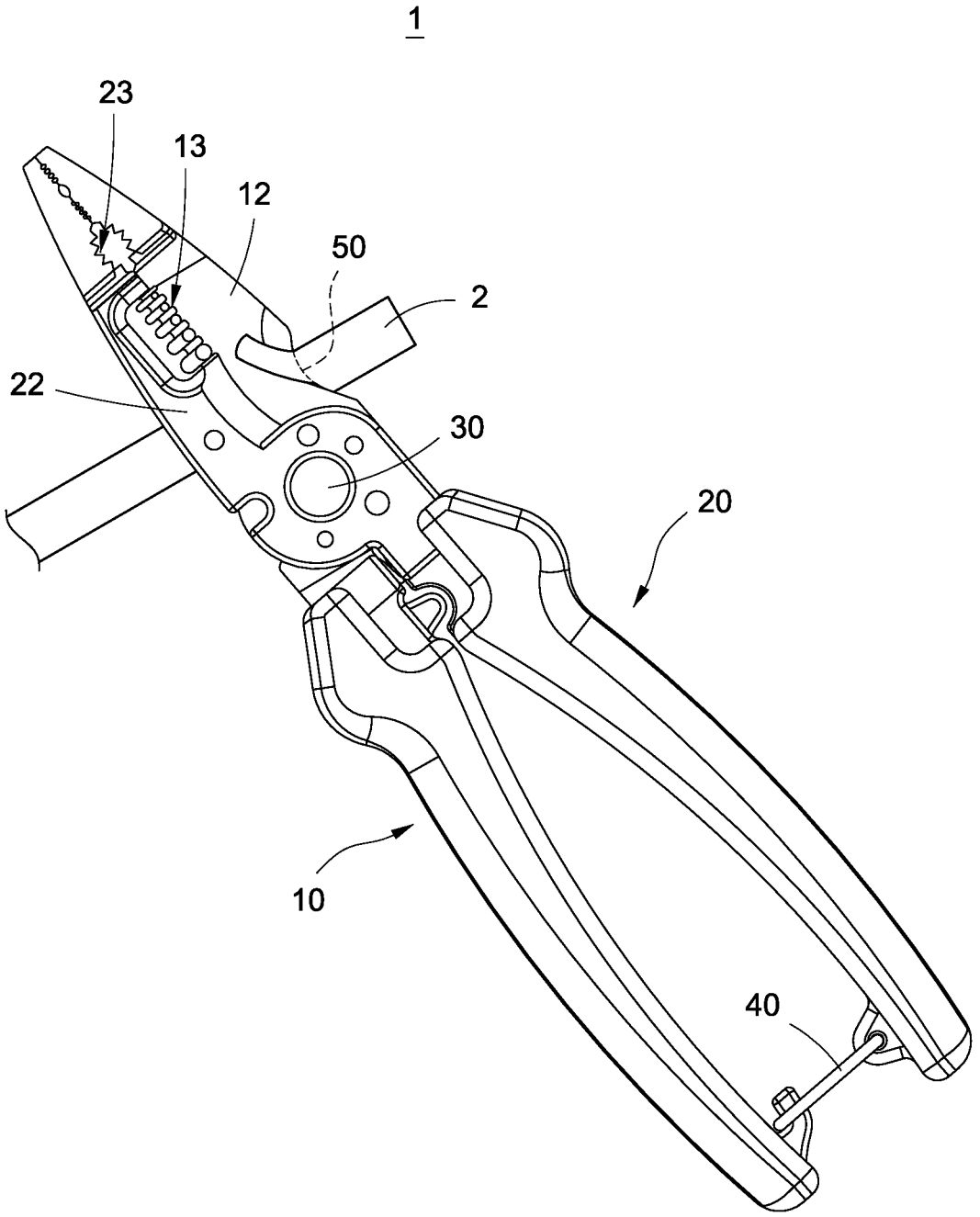
FIG. 8 is an operation schematic view of the pliers with multifunction of this disclosure when performing the chipping.

Please further refer to FIG. 8, which depicts an operation schematic view of the pliers with multifunction of this disclosure when being used for chipping. As shown in the figure, the pliers 1 of this disclosure may be used to perform chipping to a workpiece 2 (especially on the middle part of the workpiece 2) by the chipping blade 50. The chipping blade 50 may perform a precise chipping operation to the workpiece 2 without causing damage to the workpiece 2. It should be noted that the first pliers body 10 is engaged with the second pliers body 20 through the buckle 40. As a result, the first clamp 12 and the second clamp 22 are held in a closed status without exposing the first pliers knife 13 and the second pliers knife 23. Therefore, the user may not touch the first pliers knife 13 or the second pliers knife 23 when performing the chipping. The user may be prevented from being injured during the operation, so as to enhance the safety of use.

While this disclosure has been described by means of specific embodiments, numerous modifications and variations could be made thereto by those skilled in the art without departing from the scope and spirit of this disclosure set forth in the claims.

What is claimed is:

1. A pliers (1), comprising:

a first pliers body (10), comprising a first handle (11) and a first clamp (12) connected to a front end of the first handle (11), wherein a first pliers knife (13) and a first pliers back (14) are disposed on opposite sides of the first clamp (12); and a second pliers body (20), comprising a second handle (21) and a second clamp (22) connected to a front end of the second handle (21), wherein a second pliers knife (23) and a second pliers back (24) are disposed on opposite sides of the second clamp (22), and the second clamp (22) is pivotally connected with the first clamp (12) to make the first pliers knife (13) be connectable with the second pliers knife (23);

wherein, one of the first pliers back (14) and the second pliers back (24) comprises a chipping blade (50) configured in a concave arc shape to perform chipping to a workpiece (2) especially on a middle part thereof without causing damage to the workpiece (2);

wherein the chipping blade (50) comprises an arc-shaped recess (51) and a straight cut (52) extended from the arc-shaped recess (51);

wherein the arc-shaped recess (51) comprises a blade angle (A) varied on different locations, and a range of the blade angle (A) is equal to or greater than 120 degrees and equal to or less than 135 degrees, which is less sharp so as to provide a safety use, and a maximum value of the blade angle (A) is located on a bottom of the arc-shaped recess (51);

wherein the straight cut (52) comprises a cut angle (B), and a range of the cut angle (B) is equal to or greater than 85 degrees and equal to or less than 90 degrees, thus an operation of chipping is realized mainly at the bottom of the arc-shaped recess (51) to avoid injury when a user touches an edge of the chipping blade (50).

2. The pliers according to claim 1, further comprising: a pivot assembly (30), comprising a bolt (31) and a stud (32), and the first pliers body (10) pivotally combined with the second pliers body (20) through the bolt (31) and the stud (32).

3. The pliers according to claim 2, wherein the first pliers body (10) comprises a first transition section (15) located between the first handle (11) and the first clamp (12), and the first transition section (15) comprises a first perforation (150);

the second pliers body (20) comprises a second transition section (25) located between the second handle (21) and the second clamp (22), and the second transition section (25) comprises a second perforation (250); and the bolt (31) and the stud (32) are inserted in the first perforation (150) and the second perforation (250).

4. The pliers according to claim 3, wherein the first transition section (15) comprises a plurality of first cutting holes (151) disposed around the first perforation (150), and the second transition section (25) comprises a plurality of second cutting holes (251) disposed around the second perforation (250); and the first cutting holes (151) and the second cutting holes (251) are arranged correspondingly.

5. The pliers according to claim 3, wherein the first clamp (12) comprises a first bending protrusion (16) located adjacent to a lower side of the first transition section (15), and the second clamp (22) comprises a second bending notch (26) located adjacent to a lower side of the second transition section (25); and the first bending protrusion (16) and the second bending notch (26) are arranged correspondingly.

6. The pliers according to claim 3, wherein the first clamp (12) comprises a first U-shaped notch (17) located adjacent to an upper side of the first transition section (15);

the second clamp (22) comprises a second U-shaped notch (27) located adjacent to an upper side of the second transition section (25); and the first U-shaped notch (17) and the second U-shaped notch (27) are arranged correspondingly.

7. The pliers according to claim 1, wherein the first pliers knife (13) comprises a first clamping section (131), a first stripping section (132) and a first cutting section (133);

the second pliers knife (23) comprises a second clamping section (231), a second stripping section (232) and a second cutting section (233);

the first clamping section (131) and the second clamping section (231) are arranged correspondingly, the first stripping section (132) and the second stripping section (232) are arranged correspondingly, and the first cutting section (133) and the second cutting section (233) are arranged correspondingly.

* * * * *